US006526879B1

(12) United States Patent
Mahoney

(10) Patent No.: US 6,526,879 B1
(45) Date of Patent: Mar. 4, 2003

(54) PRESS

(75) Inventor: Donald Simson Mahoney, Huntingdale Vic (AU)

(73) Assignee: Pryda (Aust.) PTY LTD, Melbourne (AU)

( * ) Notice: Subject to any disclaimer, the term of this patent is extended or adjusted under 35 U.S.C. 154(b) by 0 days.

(21) Appl. No.: 09/445,130

(22) PCT Filed: Jun. 1, 1998

(86) PCT No.: PCT/AU98/00401

§ 371 (c)(1),
(2), (4) Date: Feb. 29, 2000

(87) PCT Pub. No.: WO98/55289

PCT Pub. Date: Dec. 10, 1998

(30) Foreign Application Priority Data

Jun. 2, 1997 (AU) ..... PO7106

(51) Int. Cl.[7] ..... B30B 15/24
(52) U.S. Cl. ..... 100/46; 100/258 R; 100/258 A
(58) Field of Search ..... 100/46, 258 A, 100/258 R, 269.06, 207; 60/428, 475, 494; 91/171, 183

(56) References Cited

U.S. PATENT DOCUMENTS 2,283,447 A * 5/1942 MacMillin et al. ..... 100/258 A
2,286,798 A * 6/1942 Flowers ..... 100/258 A
2,302,132 A * 11/1942 MacMillin et al. ..... 100/258 A
2,635,427 A * 4/1953 Baugh et al. ..... 60/475
2,940,262 A * 6/1960 Pfitzenmeier ..... 91/520
3,054,316 A * 9/1962 Pearson ..... 100/258 R
3,054,317 A * 9/1962 Castle, Jr. ..... 100/258 R
3,120,799 A * 2/1964 Strnad et al. ..... 100/258 A
3,805,530 A * 4/1974 Richardson ..... 100/258 A
4,873,923 A * 10/1989 Manning ..... 100/258 R
5,470,428 A * 11/1995 Sanko ..... 100/207
5,472,556 A * 12/1995 Sanko ..... 100/207
5,568,766 A * 10/1996 Otremba et al. ..... 100/258 R
5,573,366 A * 11/1996 Meijer ..... 100/269.06

* cited by examiner

*Primary Examiner*—John Sipos
*Assistant Examiner*—Louis Huynh
(74) *Attorney, Agent, or Firm*—Foley & Lardner

(57) ABSTRACT

A press for fabrication of building components including: an upper platen; a lower platen; the upper platen and/or lower platen movable towards and away from the other; a first and second hydraulic device located on a base, each hydraulic device including; a cylinder; a piston located in the cylinder defining a first and a second chamber in the cylinder, the piston sealingly engaging the cylinder and movable in the cylinder; and a piston rod connected to the piston and extending through the second chamber to engage the upper or lower platen; a pump to pump hydraulic fluid into the first chamber of the first hydraulic device; and a valve in fluid communication with the first chambers of the first and second hydraulic devices to selectively withdraw hydraulic fluid from the first chamber of either or both the first and second hydraulic devices to align the upper and lower platens.

11 Claims, 10 Drawing Sheets

PRESS

BACKGROUND OF THE INVENTION

1. Field of the Invention

The invention relates generally to a press having a hydraulically controlled platen. More particularly, the press is useful for the manufacture of prefabricated building components (such as trusses) or other building components. It may also be useful in processing other articles (such as plastic sheet, plastic pipe, sheet and metal articles such as aluminum extrusions, laminated and composite timber articles).

2. Description of the Related Art

Whilst the following discussion illustrates the press used for manufacture of prefabricated building components, it is to be understood that the press may be used in other engineering applications.

Traditionally, trusses that are destined for the building industry may be constructed on-site or prefabricated. Prefabricated trusses of standard designs are very popular as they can be mass-produced by passing the assembled components between a press which fixes the components together at appropriate locations.

Typically, such presses have an upper and/or lower platen against which the fixing occurs. One form of press, which is in use in the building component prefabrication industry, has a lower platen and an upper moving platen which is designed to press down on the components disposed in between them. The pressing action pushes fasteners into the components to form timber joints of a truss assembly. The components need to be held firmly during the fixing operation to produce strong and uniform trusses. Considerable pressure is applied to the lower platen indirectly during the holding and fixing of the timber joint to achieve this. Further, the fixing is usually localized to relatively small areas of the platen where the joint to be formed is located. This area may vary across the platen depending upon where the proposed joint is positioned.

Consequently, the lower platen has to be supported by devices which prevent it moving or tilting in response to any localized pressure applied to it. A number of these types of devices have been proposed.

In Australian patent no. 543663 a hydraulic press is disclosed. A pair of rams are each provided with a hydraulic device under the tool. They are connected by a torsion bar which regulates the fluid flow into the hydraulic rams in the event that it becomes misaligned. A complex combination of bars, rocking members and springs are used to maintain the tool level.

In another arrangement, a series of manually or automatically controlled levers are provided to mechanically regulate the movement and alignment of the platen of a press. Again, this is complex and is not readily adapted to automate and regulate the pressing function of the machine.

It is an objective of the present invention to provide a press with improved adjustment of the alignment of at least one of its pressing components.

SUMMARY OF THE INVENTION

Accordingly there is provided a press for fabrication of building components including: (a) an upper platen; (b) a lower platen; (c) first and second hydraulic devices each including; (i) a cylinder; (ii) a piston located in the cylinder defining a first and a second chamber in the cylinder, the piston sealingly engaging the cylinder and movable in the cylinder; and (iii) a piston rod connected to the piston and extending through the second chamber, wherein the first and second chambers, each have an inlet/outlet for hydraulic fluid and the second chamber of the first hydraulic device is in fluid communication with the first chamber of the second hydraulic device; and each piston rod of each hydraulic device extends in engagement with one and the same of the upper or lower platens, whereby the hydraulic devices are operable to shift the upper or lower platen the piston rods engage, relatively toward or away from the other of the upper or lower platens, (d) a pump to pump hydraulic fluid into the first chamber of the first hydraulic device; and (e) a valve in fluid communication with the first chambers of the first and second hydraulic devices to selectively withdraw hydraulic fluid from the first chamber of either or both the first and second hydraulic devices to align the upper and lower platens.

In operation, hydraulic fluid is pumped into the first chamber of the first hydraulic device by the pump which causes the piston to move towards the inlet/outlet of the second chamber. The second chamber decreases in volume and forces hydraulic fluid through the inlet/outlet of the second chamber of the first hydraulic device into the first chamber of the second hydraulic device. This in turn, causes a similar displacement of the piston in the second hydraulic device and fluid present in the second chamber of the second hydraulic device flows through the inlet/outlet.

As will be well understood by engineers, hydraulic fluid is substantially incompressible and is a medium which can translate motive forces very well.

In another preferred form of the invention there is provided, a press for fabrication of building components including: (a) an upper platen connected to an upper part of a frame; (b) a lower platen; (c) spaced first and second hydraulic devices each connected at one and the same end thereof to the frame and each including; (i) a cylinder; (ii) a piston located in the cylinder defining a first and a second chamber in the cylinder, the piston sealingly engaging the cylinder and movable in the cylinder; and (iii) a piston rod connected to the piston at one end thereof and extending through the second chamber into engagement with the lower platen at the other end of the device to that connected to the frame; wherein the first and second chambers, each have an inlet/outlet for hydraulic fluid, and the second chamber of the first hydraulic device is in fluid communication with the first chamber of the second hydraulic device; (d) a pump to pump hydraulic fluid into or from the first chamber of the first hydraulic device to cause the piston rods of both hydraulic devices to move and to shift the upper or lower platen relatively towards or away from the other platen; and (e) a valve in fluid communication with the first chambers of the first and second hydraulic devices to selectively withdraw hydraulic fluid from the first chamber of either or both the first and second hydraulic devices to align the upper and lower platens.

In yet another preferred form of the invention there is provided, a press for fabrication of building components including: (a) an upper platen connected to an upper frame; (b) a lower platen connected to a lower frame; (c) spaced first and second hydraulic devices, each including; (i) a cylinder; (ii) a piston located in the cylinder defining a first and a second chamber in the cylinder, the piston sealingly engaging the cylinder and movable in the cylinder; and (iii) a piston rod connected to the piston at one end thereof and extending through the second chamber; wherein the first and second chambers, each have an inlet/outlet for hydraulic fluid, and the second chamber of the first hydraulic device is in fluid communication with the first chamber of the second hydraulic device; and each of the hydraulic devices is connected at one end to the upper frame and at the other end to the lower frame, one of the connections being with the end of the piston rods extending from the second chambers, and the devices being operable by extension or retraction of the piston rods thereof to shift the upper or lower platen relatively toward or away from the other; (d) a pump to pump hydraulic fluid into or from the first chamber of the first hydraulic devices to cause the piston rods of both hydraulic devices to move and to shift the upper or lower platen relatively towards or away from the other platen; and (e) a valve in fluid communication with the first chambers of the first and second hydraulic devices to selectively withdraw hydraulic fluid from the first chamber of either or both the first and second hydraulic devices to align the upper and lower platens.

According to another preferred form of the invention, a press for fabrication of building components is provided including: (a) an upper platen; and (b) a lower platen; (c) first and second hydraulic devices each including; (i) a cylinder having a partition sealingly engaging the walls of the cylinder and located intermediate the ends of the cylinder, to define first and second chambers of the cylinder; (ii) a first piston located in the first chamber and defining (a) a first sub-chamber between an end of the cylinder and the first piston and (b) a second sub-chamber between the first piston and the partition, the first piston sealingly engaging the cylinder and movable in the cylinder; (iii) a second piston located in the second chamber and defining (c) a third sub-chamber between the partition and the second piston and (d) a fourth sub-chamber between the second piston and the other end of the cylinder, the second piston sealingly engaging the cylinder and movable in the cylinder; and (iv) a piston rod connected to the first piston and the second piston and passing through and sealingly contacting the partition; and further extending from the fourth sub-chamber; wherein the first sub-chamber has an inlet for hydraulic fluid, the second sub-chamber has an outlet for hydraulic fluid, the third sub-chamber has an inlet/outlet for hydraulic fluid and the fourth sub-chamber has an inlet/outlet for hydraulic fluid; and the inlet/outlet of the third sub-chamber of one of the hydraulic devices is in fluid communication with the inlet/outlet of the fourth sub-chamber of the other hydraulic device; and each of the hydraulic devices is connected at one end to the upper frame and at the other end to the lower frame, one of the connections being with the end of the piston rods extending from the fourth sub-chamber and each device is operable by extension or retraction of the piston rods thereof to shift the upper or lower platens relatively toward or away from the other; (d) a pump to pump hydraulic fluid into the first sub-chamber of each of the hydraulic devices; and (e) a valve in fluid communication with the first sub-chambers of the first and second hydraulic devices to selectively withdraw hydraulic fluid from the first sub-chamber of either or both the first and second hydraulic devices to align the upper and lower platens.

In operation, hydraulic fluid flows into the sub-chamber of each of the hydraulic devices to apply a load. Typically the load applied to each hydraulic device is different. The pressure applied causes the first and second piston to move which reduces the volume of the fourth sub-chamber of each hydraulic device.

When the load is different on each hydraulic device, the fluid from the fourth sub-chamber which is under the greater pressure, forces fluid into the third sub-chamber of the other hydraulic device. This transmits an additional force to the second piston of that other hydraulic device until its fourth sub-chamber has an equal pressure to the fourth sub-chamber of the first hydraulic device.

In this way, the press reacts quickly to equalize the pressure being applied to the platen which minimizes potential misalignment of the platen.

The press according to the invention, uses the interaction of the hydraulic fluid in the cylinders as the means to maintain the platen substantially level (horizontal) irrespective of the localization of the load imposed by the tool on the platen. Accordingly, the formation of building components, between the upper platen and lower platen over extended periods of use and repetition, is consistently of a high reproducible quality.

Over time, the seals which form the sealing engagement of the piston with the cylinder will degrade and fluid will leak between the chambers in each hydraulic device. As this occurs, the total volume of fluid which resides in the chambers will change. This results in the platen becoming tilted.

Accordingly, to ameliorate this the valve is incorporated to correct any imbalance between the relative position of the pistons in the cylinders.

Preferably, the valve is located in either or both the pistons and is pressure actuated. In this embodiment, the pistons are preferably provided with a passageway which communicates between the chambers of the cylinder. The valve is located in the passageway and under predetermined pressure conditions permits hydraulic fluid to pass from one chamber to another.

In an alternate embodiment, the valve is located externally of the cylinders in a hydraulic fluid line which communicates with a reservoir of hydraulic fluid. The fluid line is connected to each of the cylinders. If the fluid pressure exceeds the predetermined amount in a cylinder, the valve opens to permit hydraulic fluid to flow out and correct any imbalance between the relative positions of the pistons in the cylinders.

In another alternate embodiment, the valve is externally of the cylinders in hydraulic fluid lines which communicate between the hydraulic devices.

In another alternate embodiment, the valve may be actuated in response to sensor signals. Sensors (e.g. electrical limit switches) are positioned to detect the position or alignment of the platen. If predetermined limits are exceeded, the sensors cause the valve or valves associated with either or both the cylinders to open. The pistons are therefore rebalanced to restore the desired alignment.

BRIEF DESCRIPTION OF THE DRAWINGS

The invention will now be further explained and illustrated by reference to the accompanying drawings in which.

DETAILED DESCRIPTION OF THE PREFERRED EMBODIMENT

Figure 1:
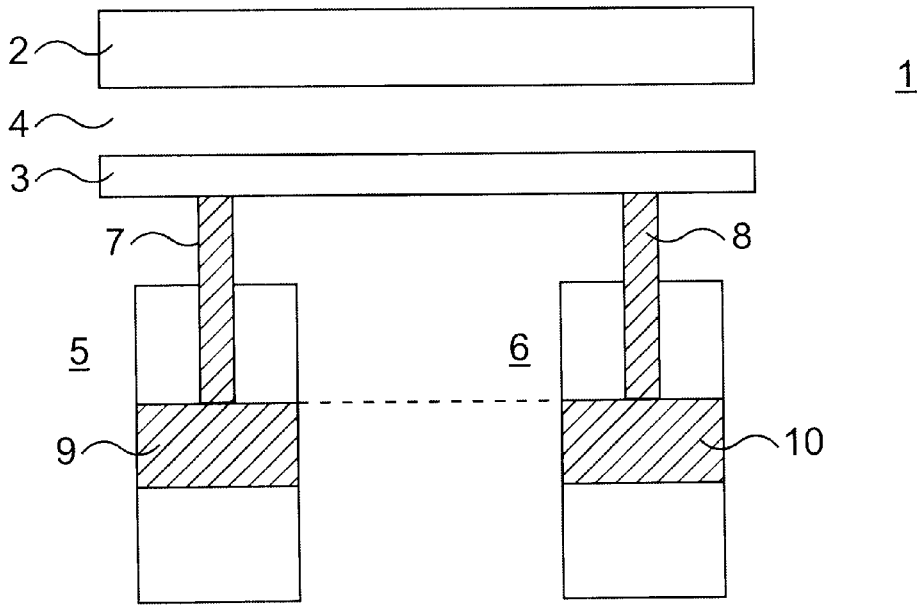
FIG. 1 is a simplified front view of a press.
Figure 2:
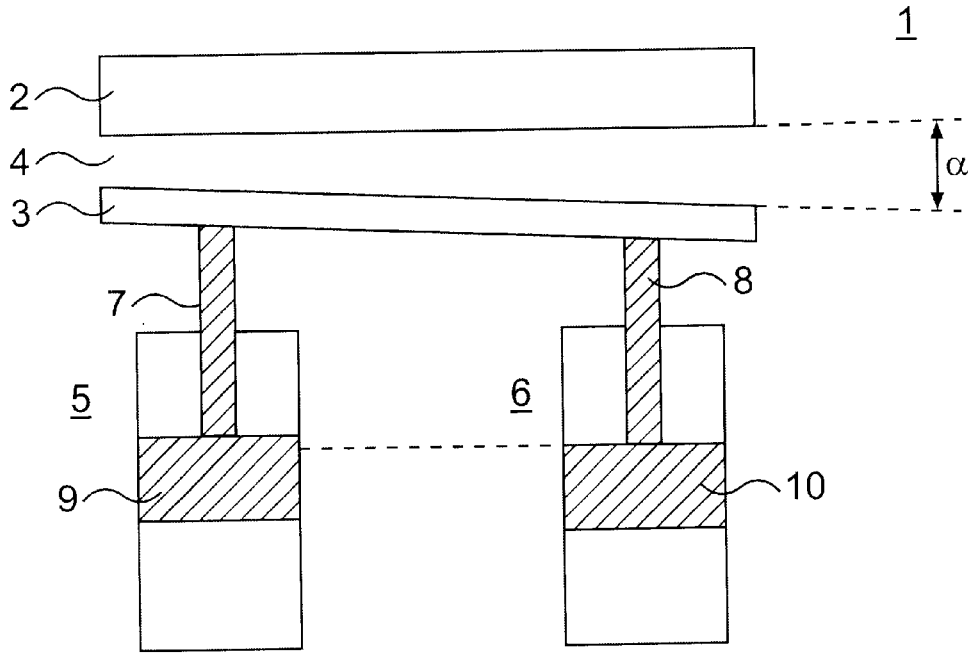
FIG. 2 is a simplified front view of the press of FIG. 1 with a misaligned platen.

In the drawings like elements are designated by the same numbers. FIGS. 1 and 2 are conceptual illustrations of a press 1 in different positions. Press 1 has an upper platen 2 and a lower platen 3. Both platens 2 and 3 are movable towards one another. An article (not shown) to be fabricated is disposed in the space 4. As the platens 2 and 3 converge, they hold the article in position to permit fasteners or the like to penetrate the article at the desired position. This means that localized impact forces may occur across the lower platen 3. These localized forces may cause the platens 2 and 3 to become misaligned as shown in FIG. 2. If the machine is automated and is carrying out repetitive fabrication steps, the integrity of the fabrication may be adversely affected.

Figure 3:
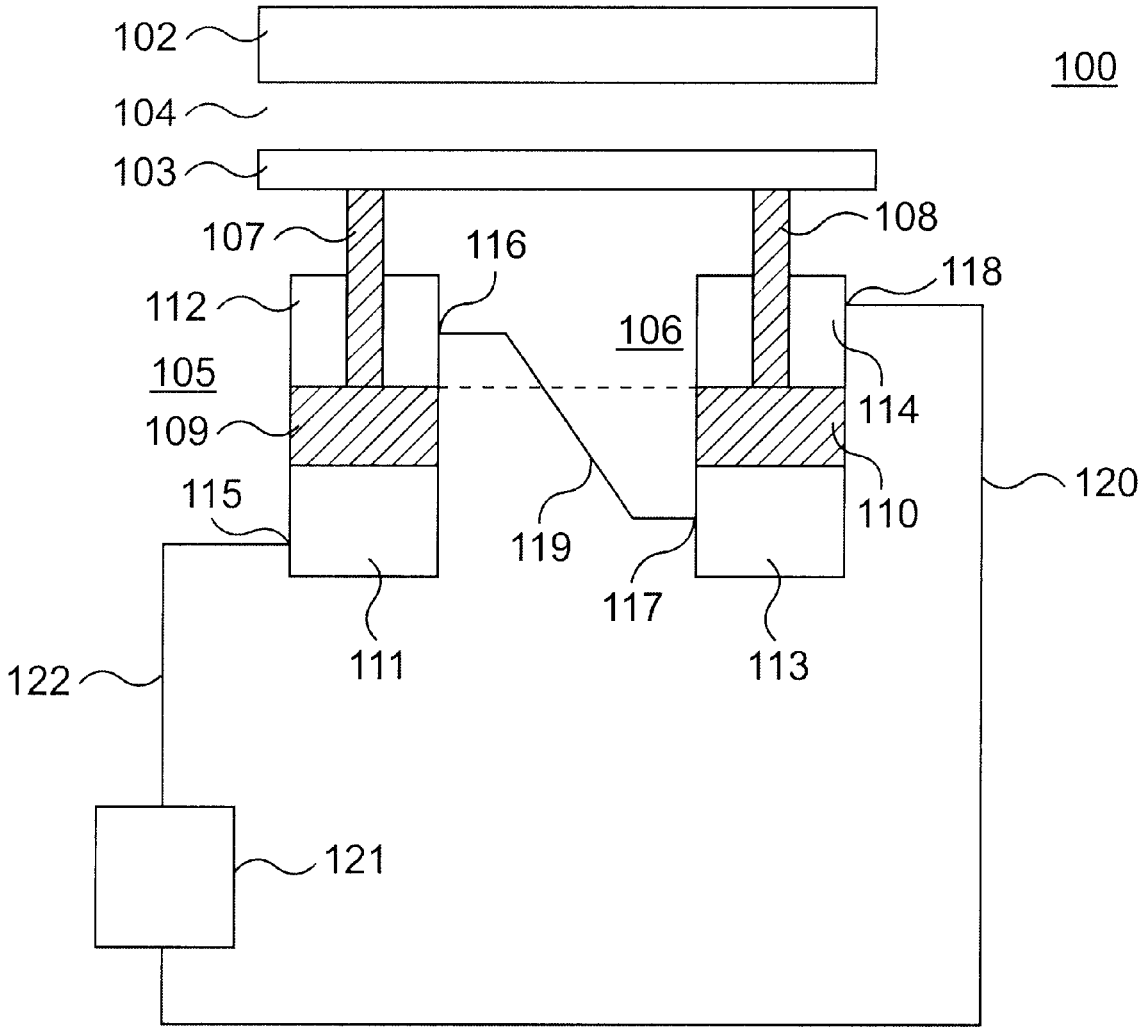
FIG. 3 is a front view of a press according to a first form of the invention.

FIG. 3 shows a form of press 100 according to the invention. Like parts from FIGS. 1 and 2 have the same reference numerals, plus 100. Lower platen 103 is supported by a pair of hydraulic cylinders 105 and 106. Cylinders 105 and 106 are connected to the lower platen 103 by piston rods 107 and 108. Piston rods 107 and 108 are connected to pistons 109 and 110 which are in sealing engagement with the walls of cylinders 105 and 106. Piston 109 defines chambers 111 and 112 in cylinder 105. Piston 110 defines chambers 113 and 114 in cylinder 106.

Cylinder 105 has a fluid inlet/outlet 115 in chamber 111 and a fluid inlet/outlet 116 in chamber 112. Cylinder 106 has a fluid inlet/outlet 117 in chamber 113 and a fluid inlet/outlet 118 in chamber 114.

Fluid line 119 connects inlet/outlet 116 to inlet/outlet 117. Fluid line 120 connects the inlet/outlet 118 to a reservoir/pump 121. Fluid line 122 connects reservoir/pump 121 to inlet/outlet 115.

In operation if the platen 103 is subjected to a localized load, the pressure will be spread differentially across the platen and transmitted differentially to the two piston rods 107 and 108. Assuming the greater load is transferred to the cylinder 106, the piston rod 108 causes the piston 110 to move against the fluid in the chamber 113. The residue of the load is applied to the piston rod 107 which in turn attempts to move the piston 109. Chamber 113 of cylinder 106 is in fluid communication with the chamber 112 of cylinder 105 via fluid line 119. Any movement of the two pistons is matched by the flow of fluid from the chamber 113 into chamber 112. The platen 103 is thereby maintained substantially level (horizontal) and does not tilt.

Likewise to raise platen 103 to carry out the fabrication, hydraulic fluid is pumped from reservoir/pump 121 through fluid line 122 into chamber 111. This urges piston 109 up and hydraulic fluid in chamber 112 is displaced to chamber 113 via fluid line 119. This in turn forces piston 110 up and hydraulic fluid is expelled to the reservoir/pump 121 via fluid line 120. In this way a distributed lifting force is applied across platen 103 to ensure that it remains substantially horizontal. To lower platen 103 the reverse procedure is carried out.

Figure 4:
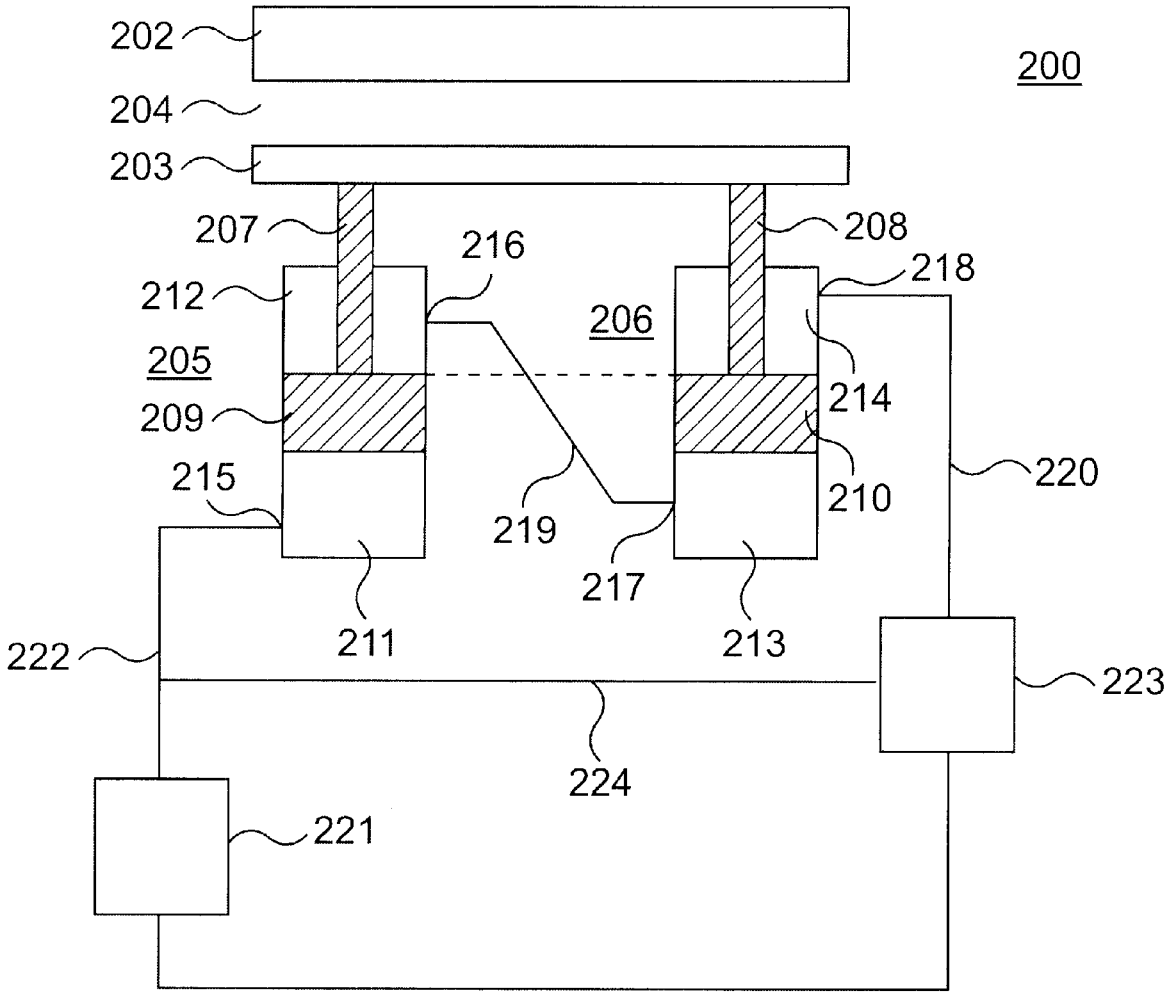
FIG. 4 is a front view of a press according to a second form of the invention.

In FIG. 4 a press 200 includes many of the features of FIGS. 1 to 3 and those features have the same third, or second and third numbers. A recycling valve 223 is interposed into fluid line 220 and a branch fluid line 224 extends from the recycling valve 223 to fluid line 222. In operation, when platen 203 is being raised, the volume of hydraulic fluid which is being pumped from the reservoir/pump 221 to cylinder 205 can be significantly reduced by opening recycle valve 223 to allow fluid being expelled through inlet/outlet 218 to flow via fluid lines 220, 224 and 222 to inlet/outlet 215.

Figure 5:
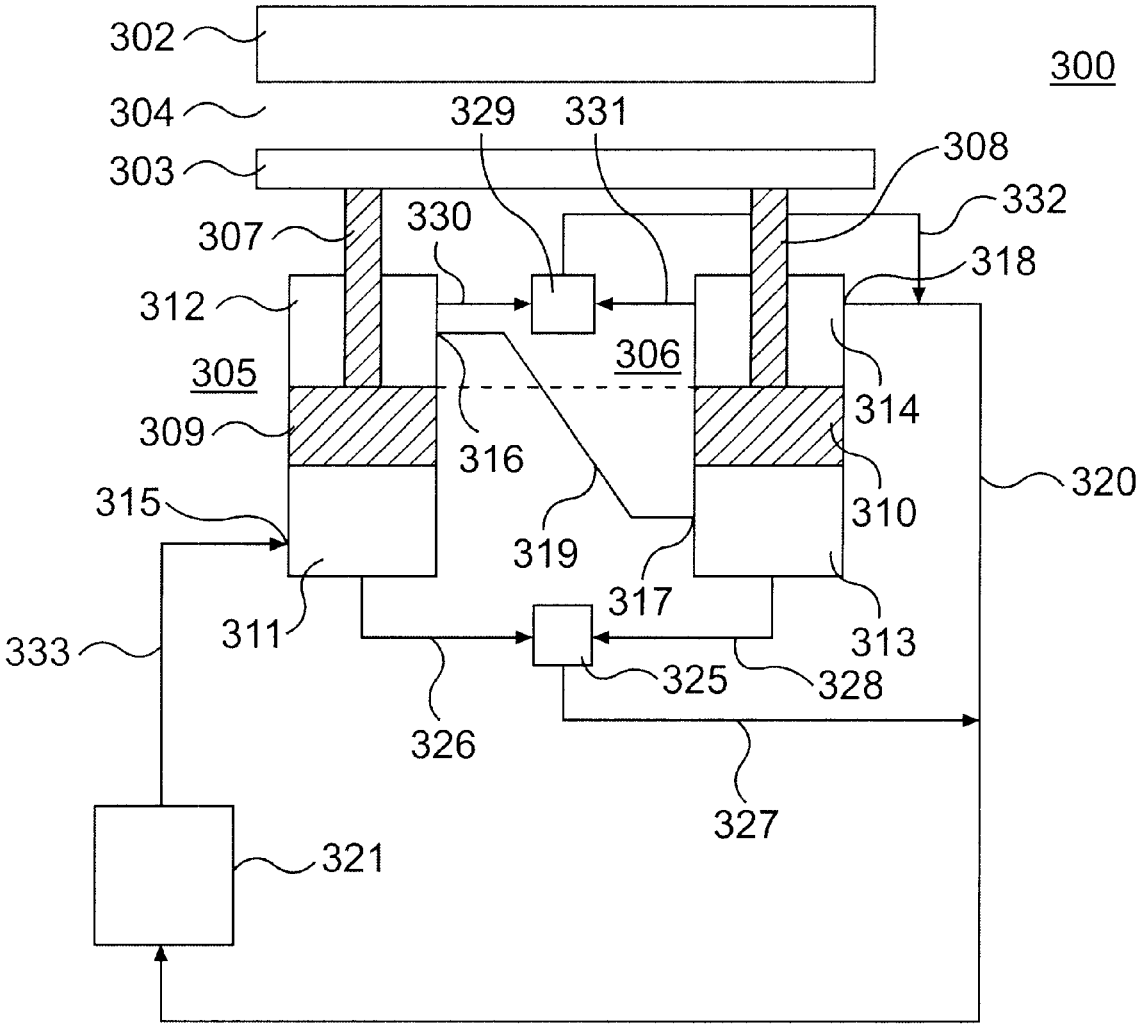
FIG. 5 is a front view of a press according to a third form of the invention.

In FIG. 5 a press 300 is shown with the same reference numeral structure as FIG. 4. This arrangement 300 is appropriate to compensate for any leaks in the seal between the pistons 309 and 310 and the cylinders 305 and 306 respectively. Over time, these seals will degrade and fluid will leak between the chambers 311 and 312 and/or chambers 313 and 314. As this occurs, the total volume of fluid which resides in chambers 312, 313 and/or chambers 313, 314 and fluid line 319 increases. As such, the relative position of the pistons 309 and 310 will change and platen 303 will be tilted.

To compensate for these leaks, one or more valves can be incorporated which are either pressure actuated or actuated using remotely generated signals. As shown in FIG. 5, fluid lines 326 and 328 are connected to chambers 311 and 313, respectively and also connect to valve 325. In the event that the chambers 311 and 313 are out of balance, valve 325 opens either or both fluid lines 326 and 328 to permit pistons 309 and 310 to again be in a balanced relationship by hydraulic fluid flowing through fluid line 327.

Likewise, a compensation circuit is connected to chambers 312 and 314 via fluid lines 330 and 331. These fluid lines 330 and 331 are both connected to valve 329 which can selectively permit fluid to flow from either or both chambers 312 and 314 to fluid line 332.

Figure 6:
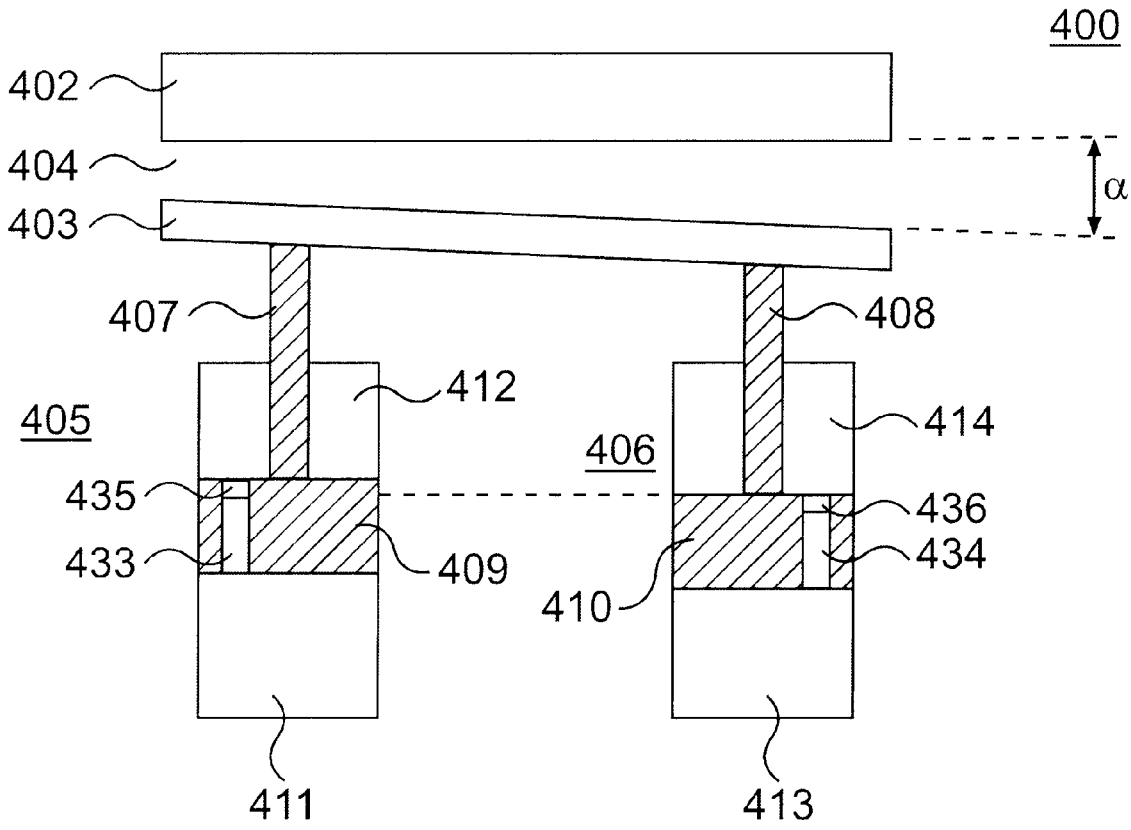
FIG. 6 is a front view of a press according to a fourth form of the invention.

In FIG. 6 a press 400 is shown, with the same reference numeral structure as FIG. 4. An alternate compensating arrangement is shown. For simplicity only, none of the external circuit is shown. However, the external circuitry as shown in FIG. 3. would be suitable. The internal compensatory circuit uses valves 435 and 436 disposed in passageways 433 and 434. As shown, the pistons 409 and 410 are out of alignment due to wearing of the seals (not shown). By opening valve 435 fluid can flow from chamber 412 to chamber 411. By opening valve 436 fluid can flow from chamber 414 to chamber 413. Typically the valves 435 and 436 are pressure actuated and only open for a time sufficient to permit the pistons 409 and 410 to be rebalanced.

Figure 7:
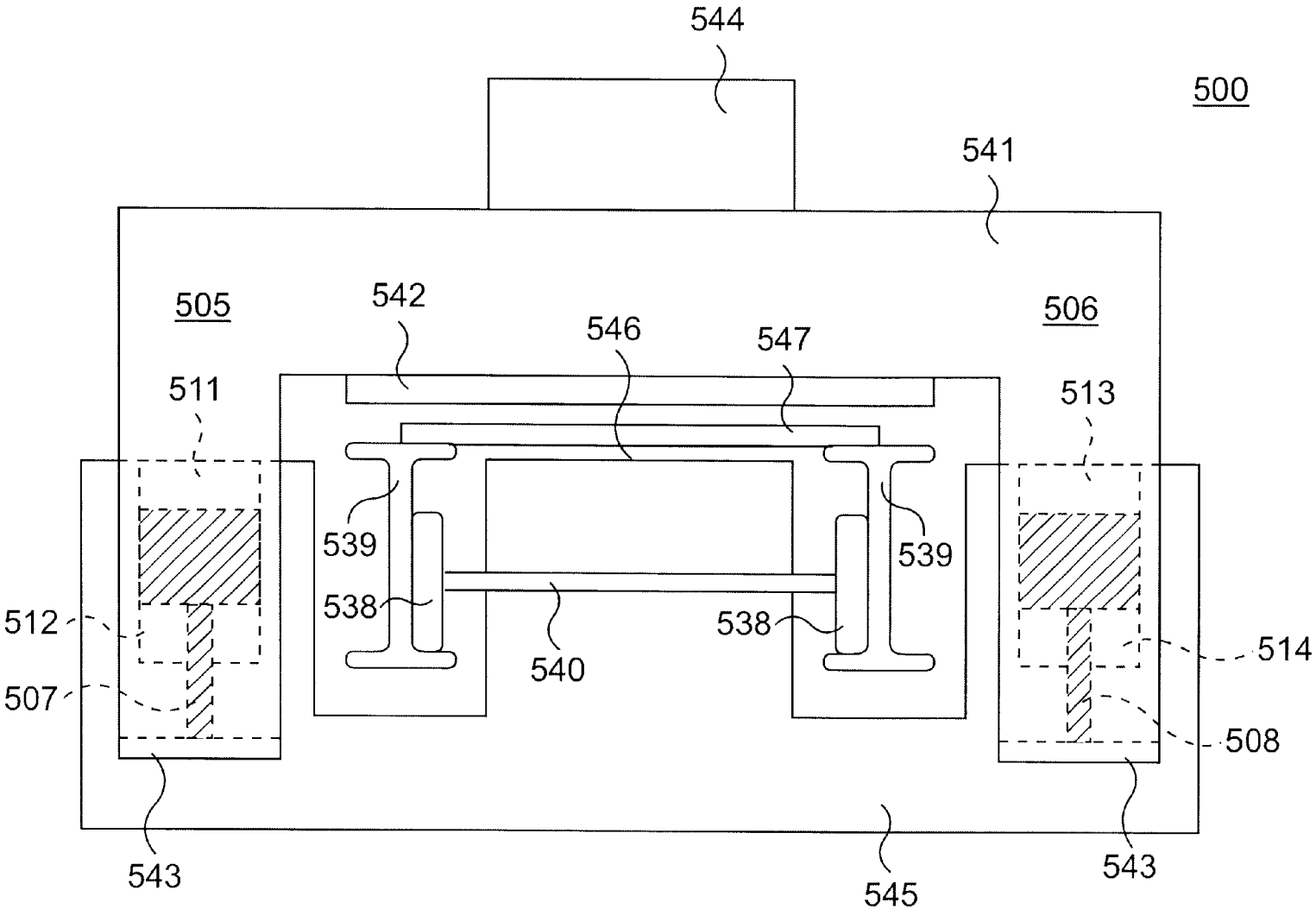
FIG. 7 is a front view of a press according to a fifth form of the invention.
Figure 8:
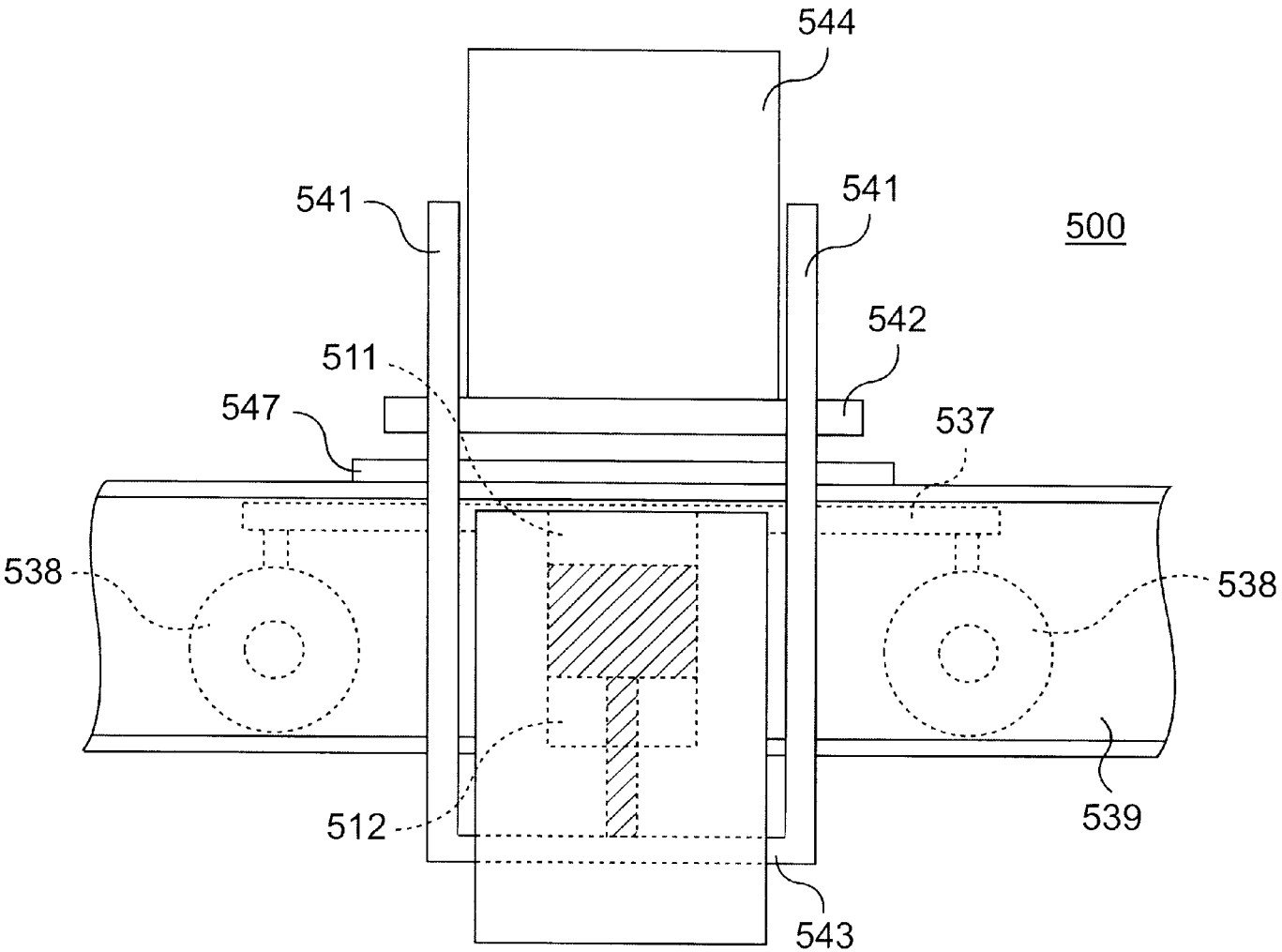
FIG. 8 is a side view of the press of FIG. 7.

FIGS. 7 and 8 show a practical arrangement of a press 500 according to the invention. The circuitry is not shown but would typically be that disclosed in FIG. 4. The press 500 is mounted on a carriage 537 which has four wheels 538. The wheels 538 engage and roll along a pair of lower flanges of rails 539. The wheels 538 are connected by axles 540.

The carriage 537 has a base frame which is composed of a pair of spaced upright plates 541 which are connected by platen 542 (which is also the upper platen) and a pair of plates 543. A recess is formed by the plates 541 and platen 542 in which a hydraulic power pack 544 resides. Hydraulic power pack 544 controls the fluid circuitry (not shown).

Located in between the plates 541 is a lower sub-frame 545. Hydraulic cylinders 505 and 506 are connected to sub-frame 545 whilst the piston rods 507 and 508 are connected to plates 543 in the base frame. Sub-frame 545 has a lower platen 546. In operation, the article 547 to be fabricated is to be held between upper platen 542 and lower platen 546. To move the lower platen 546 upward, fluid is pumped into chamber 512 (as shown in FIG. 4) and accordingly fluid is displaced from chamber 511 to chamber 514. The upper platen 542 is initially lowered until it rests on the article 547. The lower platen 546 is then raised to sandwich article 547 with upper platen 542 and lift the four wheels 538 off the rails 539. The reverse procedure is followed to lower the lower platen 546.

Figure 9:
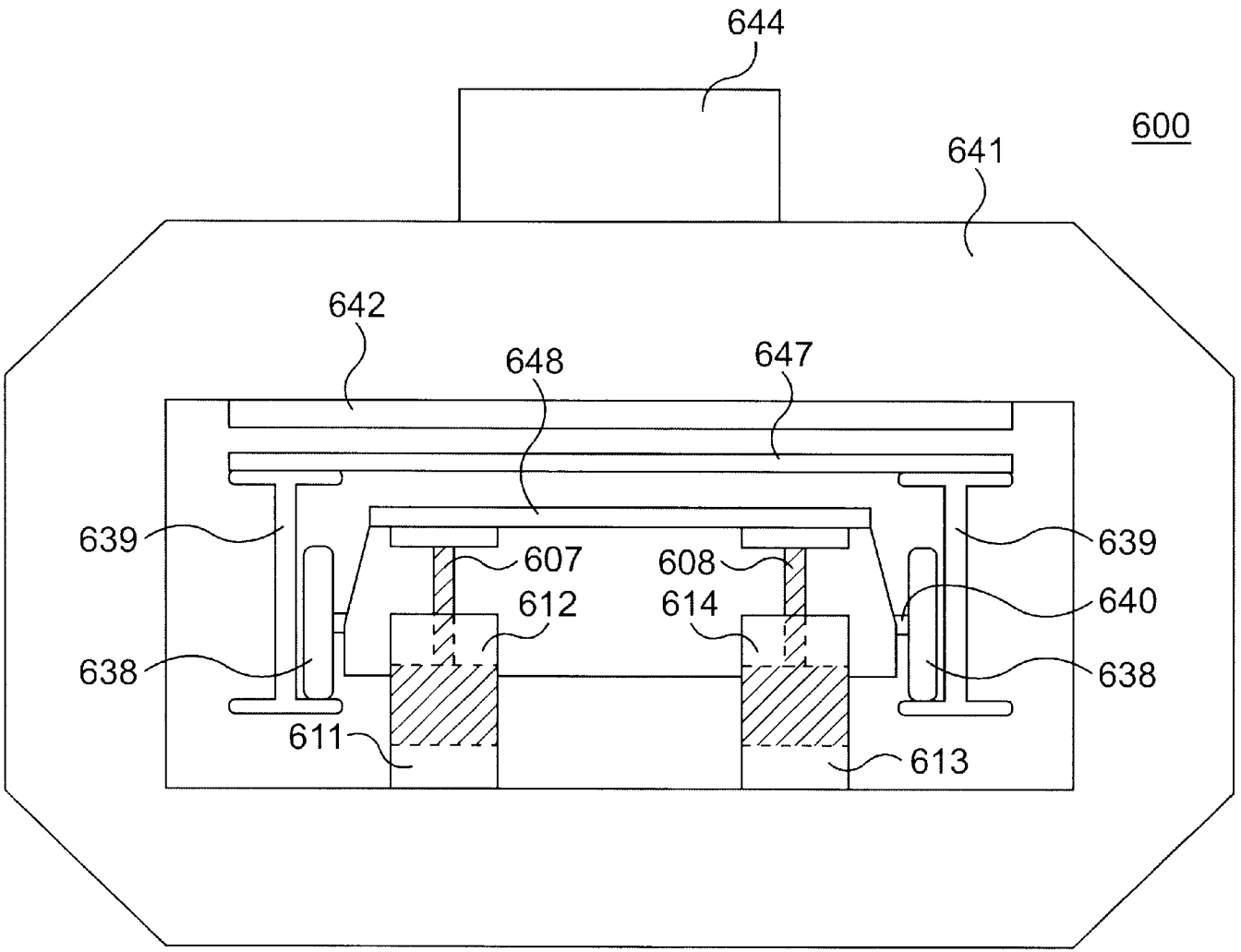
FIG. 9 is a front view of a press according to a sixth form of the invention.
Figure 10:
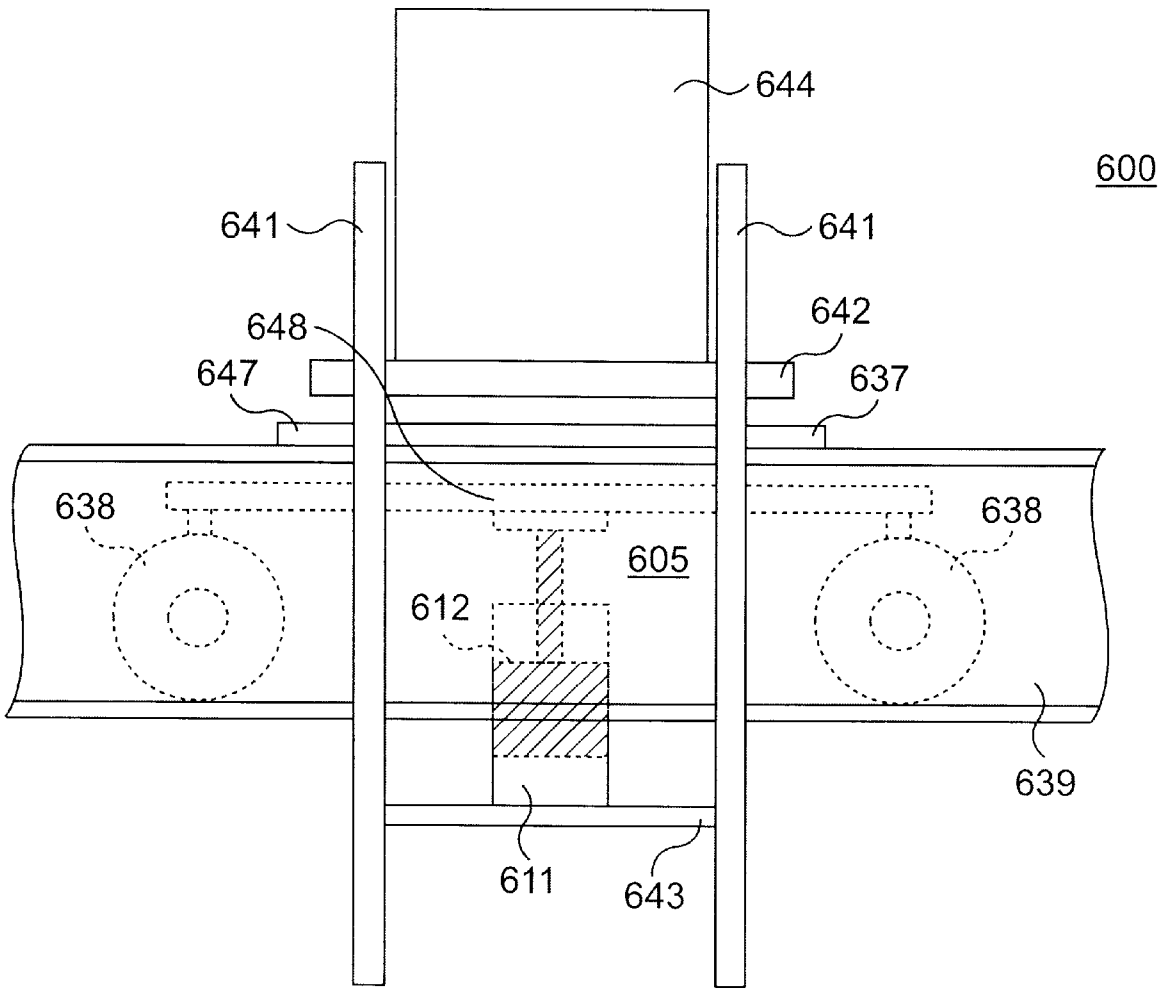
FIG. 10 is a side view of the press of FIG. 9.

FIGS. 9 and 10 show another practical arrangement of a press 600 according to the invention. Again the circuitry is not shown but would typically be that disclosed in FIG. 4. The press 600 is mounted on a carriage 637 which has four wheels 638. The wheels 638 engage and roll along a pair of lower flanges of rails 639. The wheels 638 are connected by axles 640 which are in turn connected to the lower platen 648.

The carriage 637 has a base frame which is composed of a pair of spaced upright plates 641 which are connected by platen 642 (which is also the upper platen) and a pair of plates 643. A recess is formed by the plates 641 and platen 642 in which a hydraulic power pack 644 resides. Hydraulic power pack 644 controls the fluid circuitry (not shown).

Located in-between the plates 641 and on the plates 643 are hydraulic cylinders 605 and 606. Piston rods 607 and 608 are connected to lower platen 648. In operation, the article 647 to be fabricated is between upper platen 642 and lower platen 648. To initially move the upper platen 642 downward and then move the lower platen upward, fluid is pumped into chamber 611 (equivalent to chamber 211 as shown in FIG. 4) and accordingly fluid is displaced from chamber 612 to chamber 613. The lower platen 648 is finally raised to sandwich article 647 with upper platen 642 which movement raises the wheels 638 off the rails 639. The reverse procedure is followed to lower the lower platen 648.

Figure 11:
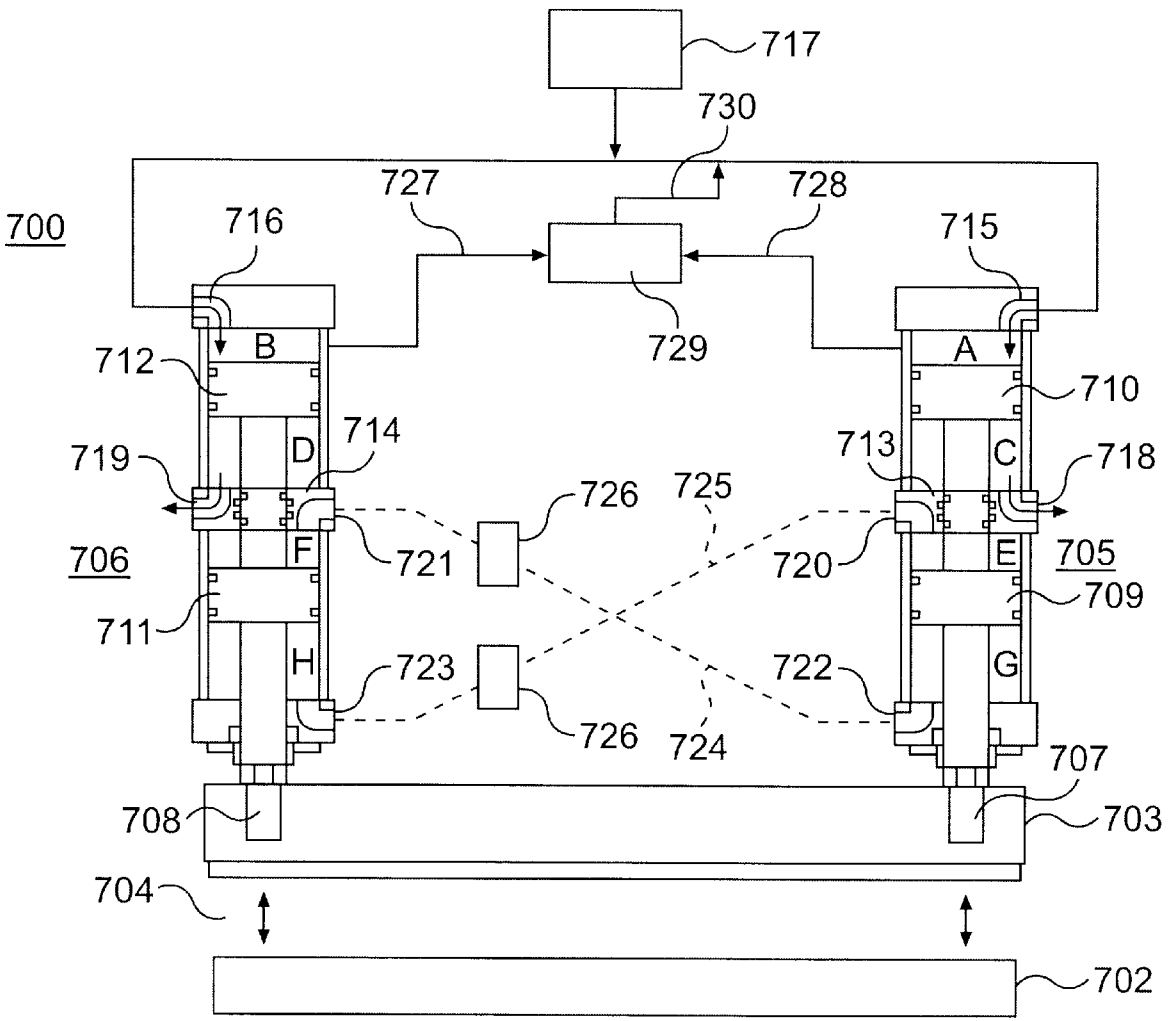
FIG. 11 is a conceptual illustration of a press according to a seventh form of the invention.

FIG. 11 shows conceptually another alternative. Press 700 has a lower platen 702 and an upper platen 703. Both platens 702 and 703 are movable towards one another. An article (not shown) to be fabricated is disposed in the space 704. As the platens 702 and 703 converge, they hold the article in position to permit fasteners or the like to penetrate the article at the desired position. This means that localized impact forces may occur across the lower platen 703. These localized forces may cause the platens 702 and 703 to become misaligned. If the machine is automated and is carrying out repetitive fabrication steps, the integrity of the fabrication may be adversely affected.

Upper platen 703 is controlled by a pair of hydraulic cylinders 705 and 706. Cylinders 705 and 706 are connected to the upper platen 703 by piston rods 707 and 708. Piston rods 707 and 708 are connected to pistons 709 and 710 in cylinder 705 and pistons 711 and 712 of cylinder 706 respectively. These pistons are in sealing engagement with the walls of the cylinders.

Intermediate piston 709 and 710 is partition 713, whilst intermediate pistons 711 and 712 is partition 714. These partitions 713 and 714 sealingly engage cylinders 705 and 706 and also permit piston rods to pass therethrough in a sealed arrangement.

The upper ends of cylinders 705 and 706 define first sub-chambers A and B with pistons 710 and 712 respectively. The pistons 710 and 712 define second sub-chambers C and D with partitions 713 and 714 respectively. The pistons 709 and 711 define third sub-chambers E and F with partitions 710 and 712 respectively. The lower ends of cylinders 705 and 706 define fourth sub-chambers G and H with pistons 709 and 711 respectively.

The first sub-chambers A and B have an inlet 715 and 716 for hydraulic fluid from a hydraulic fluid pump 717. The second sub-chambers C and D have an outlet 718 and 719 for hydraulic fluid. The third sub-chambers have an inlet/outlet 720 and 721 for hydraulic fluid. The fourth sub-chambers have an inlet/outlet 722 and 723 for hydraulic fluid. Fluid line 724 connects inlet/outlet 721 and 722, whilst fluid line 725 connects inlet/outlet 720 and 723.

To compensate for any leaks between the sub-chambers, one or more valves 726 can be incorporated which are either pressure actuated or actuated using remotely generated signals. Also, valve lines 727 and 728 may be provided to connect the first sub-chambers A and B with a valve 729, so that if chambers A and B are out of balance, valve 729 opens either or both of fluid lines 727 and 728 to permit pistons 710 and 712 to be balanced by fluid flowing through line 730. This arrangement is effectively the same as that shown in FIG. 5 in relation to the valve 325.

In operation, hydraulic fluid flows into the first sub-chamber A and B of each of the hydraulic cylinders 705 and 706 to apply a load. The load applied to each cylinder 705 and 706 is invariably different. The pressure applied causes the pistons 709 and 710, and 711 and 712 to move which reduces the volume of the fourth sub-chambers G and H.

When the load is larger in hydraulic cylinder 705 than in hydraulic cylinder 706, the fluid from the fourth sub-chamber G of cylinder 705, forces fluid into the third sub-chamber (F) of cylinder 706. This transmits an additional force to piston 711 of cylinder 706 until fourth sub-chamber H has an equal pressure to the fourth sub-chamber G of cylinder 705.

In this way, the press reacts quickly to equalize the pressure being applied to the platen which minimizes potential misalignment of the platen.

Presses according to the invention, use the interaction of the hydraulic fluid in the cylinders as the means to maintain the platen substantially level (horizontal) irrespective of the localization of the load imposed by the tool on the platen. Improvements and modifications will be readily apparent to those skilled in the art and are considered to be within the scope and spirit of the invention.

The claims defining the invention are as follows:

1. A press comprising:

a) an upper platen;

b) a lower platen;

c) a first and second hydraulic device each including:

i) a cylinder;

ii) a piston located in the cylinder defining a first and a second chamber in the cylinder, the piston sealingly engaging the cylinder and movable in the cylinder; and iii) a piston rod connected to the piston and extending through the second chamber, wherein the first and second chambers, each have an inlet/outlet for hydraulic fluid and the second chamber of the first hydraulic device is in fluid communication with the first chamber of the second hydraulic device; and wherein each piston rod of each hydraulic device engages one of the upper and lower platens whereby the hydraulic devices are operable to shift, relatively, the platen with which the pistons rods are engaged toward or away from the other platen, d) a pump to pump hydraulic fluid into the first chamber of the first hydraulic device; and e) a valve in fluid communication with the first chambers of the first and second hydraulic devices, wherein said valve is adapted to respond to a pressure in either of said first chambers measured by a sensing means upon a misalignment of said platens, and wherein said valve is adapted to selectively withdraw hydraulic fluid from the first chamber of either or both the first and second hydraulic devices to align the upper and lower platens.

2. A press according to claim 1, wherein the pump is additionally adapted to pump hydraulic fluid from the first chamber of the first hydraulic device.

3. A press according to claim 1, wherein the valve is adapted to correct any imbalance between the relative positions of the pistons in the cylinders.

4. A press according to claim 3, wherein the valve is located externally of the cylinders in a hydraulic fluid line which communicates between the hydraulic devices.

5. A press according to claim 3, wherein the valve is located externally of the cylinders in a hydraulic fluid line connected to each of the cylinders which communicates with a reservoir for hydraulic fluid.

6. A press comprising:

a) an upper platen connected to an upper part of a frame;

b) a lower platen;

c) spaced first and second hydraulic devices each connected at one and the same end thereof to the frame and each including:

i) a cylinder;

ii) a piston located in the cylinder defining a first and a second chamber in the cylinder, the piston sealingly engaging the cylinder and movable in the cylinder; and iii) a piston rod connected to the piston at one end thereof and extending through the second chamber into engagement with the lower platen at the other end of the device to that connected to the frame;

wherein the first and second chambers, each have an inlet/outlet for hydraulic fluid, and the second chamber of the first hydraulic device is in fluid communication with the first chamber of the second hydraulic device;

d) a pump to pump hydraulic fluid into or from the first chamber of the first hydraulic device to cause the piston rods of both hydraulic devices to move and to shift, relatively, the upper or the lower platen towards or away from the other platen; and e) a valve in fluid communication with the first chambers of the first and second hydraulic devices, wherein said valve is adapted to respond to a pressure in either of said first chambers measured by a sensing means upon a misalignment of said platens, and wherein said valve is adapted to selectively withdraw hydraulic fluid from the first chamber of either or both the first and second hydraulic devices to align the upper and lower platens.

7. A press comprising:

a) an upper platen connected to an upper frame;

b) a lower platen connected to a lower frame;

c) spaced first and second hydraulic devices, each including:

i) a cylinder;

ii) a piston located in the cylinder defining a first and a second chamber in the cylinder, the piston sealingly engaging the cylinder and movable in the cylinder; and iii) a piston rod connected to the piston at one end thereof and extending through the second chamber;

wherein the first and second chambers, each have an inlet/outlet for hydraulic fluid, and the second chamber of the first hydraulic device is in fluid communication with the first chamber of the second hydraulic device;

wherein each of the hydraulic devices is connected at one end to the upper frame and at the other end to the lower frame, one of the connections being with the end of the piston rods extending from the second chambers; and wherein the hydraulic devices are operable by extension or retraction of the piston rods to shift, relatively, the upper or the lower platen toward or away from the other platen;

d) a pump to pump hydraulic fluid into or from the first chamber of the first hydraulic device to cause the piston rods of both hydraulic devices to move and to shift the upper or lower platen relatively towards or away from the other platen; and e) a valve in fluid communication with the first chambers of the first and second hydraulic devices, wherein said valve is adapted to respond to a pressure in either of said first chambers measured by a sensing means upon a misalignment of said platens, and wherein said valve is adapted to selectively withdraw hydraulic fluid from the first chamber of either or both the first and second hydraulic devices to align the upper and lower platens.

8. A press comprising:

a) an upper platen; and b) a lower platen;

c) first and second hydraulic devices each including:

i) a cylinder having a partition sealingly engaging the walls of the cylinder and located intermediate the ends of the cylinder, to define first and second chambers of the cylinder;

ii) a first piston located in the first chamber and defining (a) a first sub-chamber between an end of the cylinder and the first piston and (b) a second sub-chamber between the first piston and the partition, the first piston sealingly engaging the cylinder and movable in the cylinder;

iii) a second piston located in the second chamber and defining (c) a third sub-chamber between the partition and the second piston and (d) a fourth sub-chamber between the second piston and the other end of the cylinder, the second piston sealingly engaging the cylinder and movable in the cylinder; and iv) a piston rod connected to the first piston and the second piston and passing through and sealingly contacting the partition, and further extending from the fourth sub-chamber;

wherein the first sub-chamber has an inlet for hydraulic fluid, the second sub-chamber has an outlet for hydraulic fluid, the third sub-chamber has an inlet/outlet for hydraulic fluid and the fourth sub-chamber has an inlet/outlet for hydraulic fluid;

wherein the inlet/outlet of the third sub-chamber of one of the hydraulic devices is in fluid communication with the inlet/outlet of the fourth sub-chamber of the other hydraulic device; and wherein each of the hydraulic devices is connected at one end to the upper frame and at the other end to the lower frame, one of the connections being with the end of the piston rods extending from the fourth sub-chamber; and wherein each hydraulic device is operable by extension or retraction of the piston rods to shift, relatively, the upper or the lower platen toward or away from the other platen;

d) a pump to pump hydraulic fluid into the first sub-chamber of each of the hydraulic devices e) a valve in fluid communication with the first sub-chambers of the first and second hydraulic devices, wherein said valve is adapted to respond to a pressure in either of said first sub-chambers measured by a sensing means upon a misalignment of said platens, and wherein said valve is adapted to selectively withdraw hydraulic fluid from the first sub-chamber of either or both the first and second hydraulic devices to align the upper and lower platens.

9. A press according to claim 8, wherein the valve is located externally of the cylinders in a hydraulic fluid line connected to each of the cylinders which communicates with a reservoir of hydraulic fluid.

10. A press according to claim 8, wherein the valve is located externally of the cylinders in a hydraulic fluid line which communicates between the hydraulic devices.

11. A press according to claim 8, wherein the valve is actuated in response to a change in a total volume of the hydraulic fluid in the hydraulic devices.

* * * * *